US008171856B1

(12) United States Patent
Arnal et al.

(10) Patent No.: US 8,171,856 B1
(45) Date of Patent: May 8, 2012

(54) RAIL TRANSPORT SYSTEM HAVING A MODULAR RECONFIGURABLE RAIL ASSEMBLY

(75) Inventors: David B. Arnal, Mount Laurel, NJ (US); Timothy T. Broderick, Voorhees, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 339 days.

(21) Appl. No.: 12/335,829

(22) Filed: Dec. 16, 2008

(51) Int. Cl.
*B61B 3/00* (2006.01)

(52) U.S. Cl. ..... 104/89; 104/91; 104/106

(58) Field of Classification Search ..... 104/89, 104/91, 93, 94, 95, 106, 107, 110, 111; 238/240, 238/241, 242, 151, 172, 173, 175
See application file for complete search history.

(56) References Cited

U.S. PATENT DOCUMENTS 1,869,138 A * 7/1932 Forest et al. ..... 238/240
3,687,367 A * 8/1972 Schurch et al. ..... 238/151
4,014,071 A * 3/1977 Janson ..... 16/93 R
4,480,157 A * 10/1984 Ishikura et al. ..... 191/34
4,520,733 A * 6/1985 Willmann ..... 104/93
4,967,669 A * 11/1990 Kuchta ..... 104/106
5,060,575 A * 10/1991 Hallett et al. ..... 104/130.07
5,150,655 A * 9/1992 Sakai ..... 104/89
5,443,151 A * 8/1995 Taylor ..... 198/860.1
5,687,649 A * 11/1997 Koeninger et al. ..... 104/106
5,709,152 A * 1/1998 Ohara et al. ..... 104/89
6,125,765 A * 10/2000 Loomer ..... 104/89
6,202,566 B1 * 3/2001 Hutchinson ..... 105/148
6,269,751 B1 8/2001 Hauck et al.
6,854,397 B2 * 2/2005 Terajima et al. ..... 104/95

* cited by examiner

*Primary Examiner* — S. Joseph Morano
*Assistant Examiner* — Jason C Smith
(74) *Attorney, Agent, or Firm* — Howard IP Law Group, PC

(57) ABSTRACT

A rail transport system includes a rail assembly having at least two rail modules; at least one angled tongue element disposed at an end of the at least two rail modules; at least one angled groove element disposed at an end of the other one of the at least two rail modules, the at least one angled groove element for receiving the at least one angled tongue element when the at least two rail modules are assembled together; and at least one transport device for running along the rail assembly and transporting articles from one location to another. The rail transport system may further include first and second chain-wrench assemblies for securing the at least two rail modules to one another.

30 Claims, 8 Drawing Sheets

RAIL TRANSPORT SYSTEM HAVING A MODULAR RECONFIGURABLE RAIL ASSEMBLY

GOVERNMENTAL INTEREST

This invention was made with Government support under Contract No. N00024-03-C-5115 awarded by the Department of the Navy. The Government has certain rights in this invention.

FIELD OF INVENTION

This invention relates to transport systems, and more particularly, to rail transport systems having a modular reconfigurable rail assembly, which allows for guided movement thereon of one or more rail-mounted transport devices.

BACKGROUND OF THE INVENTION

When cabinets and equipment need to be moved into and out of a combat space on a Navy ship, the false deck and associated gridwork must be protected because it is not designed to support the weight of the cabinets and equipment being installed in the space.

A current method for moving cabinets and equipment into or out of the combat space involves fabricating a temporary platform to roll the cabinets and equipment over the false deck and associated gridwork. Immobile rigging equipment, including for example, chain falls, are secured to the overhead structure to lift equipment and cabinets and install rollers underneath.

The above method provides for slow and inefficient transport of the cabinet and equipment. Moreover, the temporary platform negatively impacts the ship's structure and other systems.

Accordingly, an improved method is needed for transporting cabinets and equipment into and out of a combat space on a Navy ship.

SUMMARY

Disclosed herein is a rail transport system comprising: a rail assembly including at least two rail modules; at least one angled tongue element disposed at an end of the at least two rail modules; and at least one angled groove element disposed at an end of the other one of the at least two rail modules, the at least one angled groove element for receiving the at least one angled tongue element when the at least two rail modules are assembled together.

Also disclosed herein is a method for moving articles into and out of a combat space on a ship, the method comprising the steps of: suspending a rail transport system above a false deck of the ship, the rail transport system including rail assembly and a transport device movable along the rail assembly; at a location remote from the combat space, attaching one of the articles to the transport device; moving the transport device along the rail assembly to the combat space; and detaching the article from the transport device at the combat space.

DETAILED DESCRIPTION OF THE INVENTION

Figure 1:
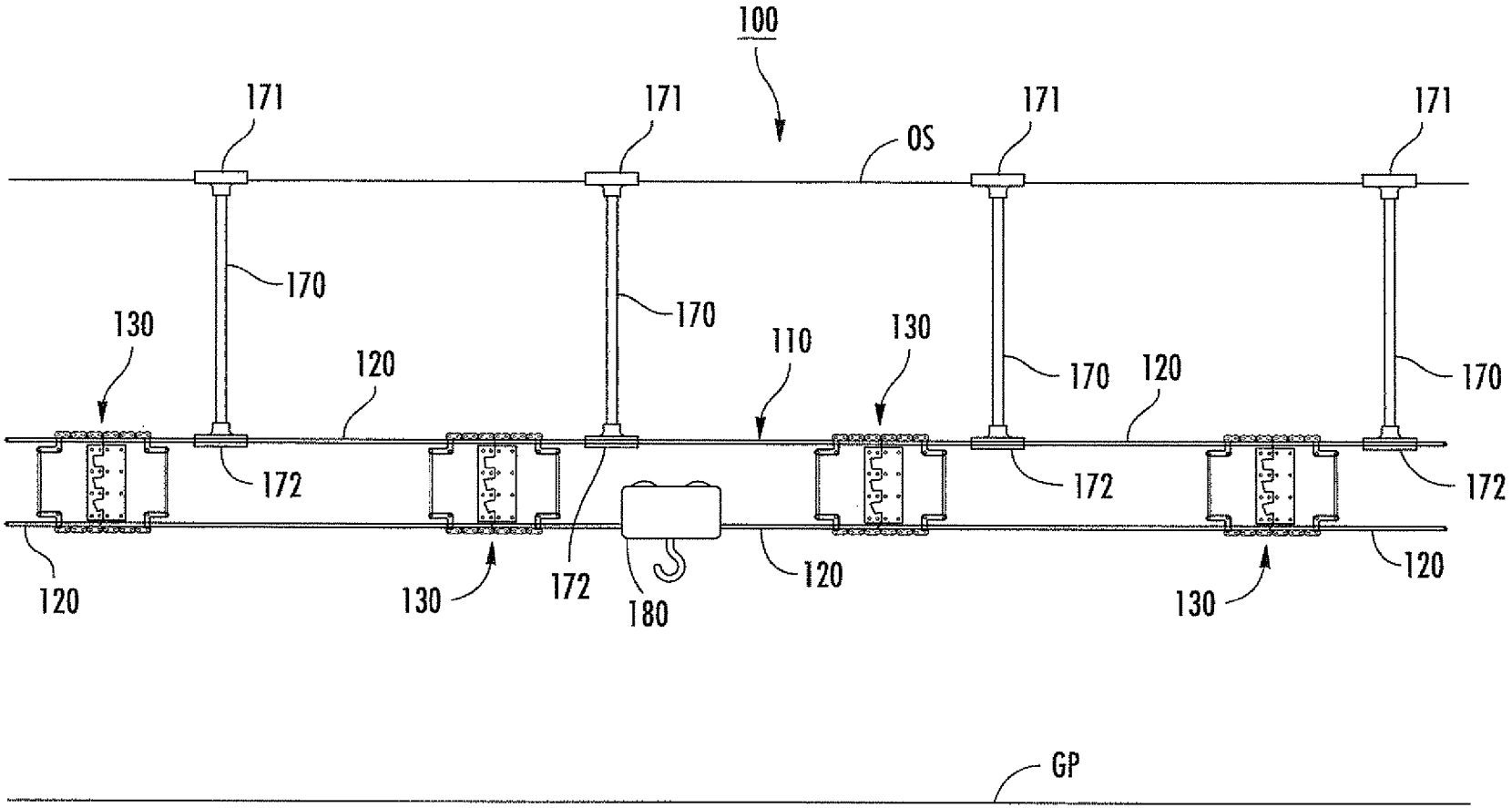
FIG. 1 is an elevational side view of an embodiment of a rail transport system.
Figure 5:
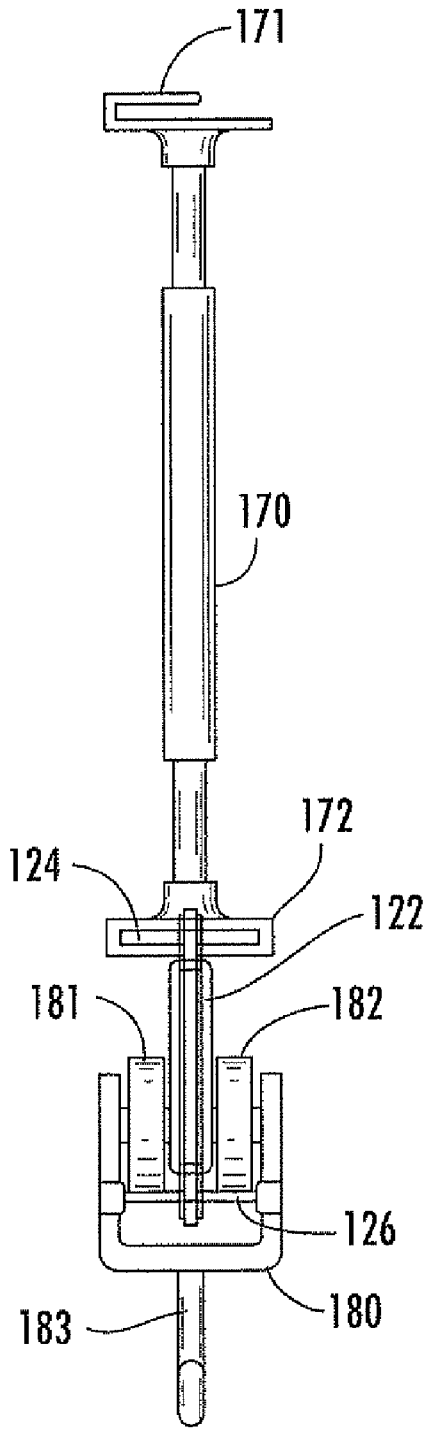
FIG. 5 is an elevational end view of the rail module showing a strut rod connected to the rail module and a wheeled transport device mounted on the rail module.

FIG. 1 shows a rail transport system 100 according to an embodiment of the present disclosure. The rail transport system 100 includes a modular, reconfigurable rail assembly 110 suspended from an overhead structure OS by strut rods 170 so that the rail assembly 110 is disposed above a ground plane GP. The strut rods 170 may be fixed in length and/or adjustable length to conform to the overhead structure OS so that the rail transport system 100 can be disposed above the ground plane GP in a level manner. The upper ends of the strut rods 170 may be permanently or removably attached to the overhead structure OS using any suitable coupler 171 and locking mechanism. In one embodiment, as shown in FIG. 5, the coupler 171 may have a clamp-like structure that grasps the overhead structure OS. A quarter-turn lock may be used to lock the coupler 171 to the overhead structure OS OS. The quarter turn locks are well-known in the art and typically include a cam-action wedge with a lever attached thereto. When the lever is turned to an unlock position, the wedge disengages from the overhead structure OS. When the lever is turned a quarter turn to a lock position, the wedge engages the overhead structure OS. In an alternate embodiment, a screw arrangement similar in function to a C-clamp may also be used. As will be explained in detail further on, the rail transport system 100 may be assembled quickly into any required configuration.

Figure 2:
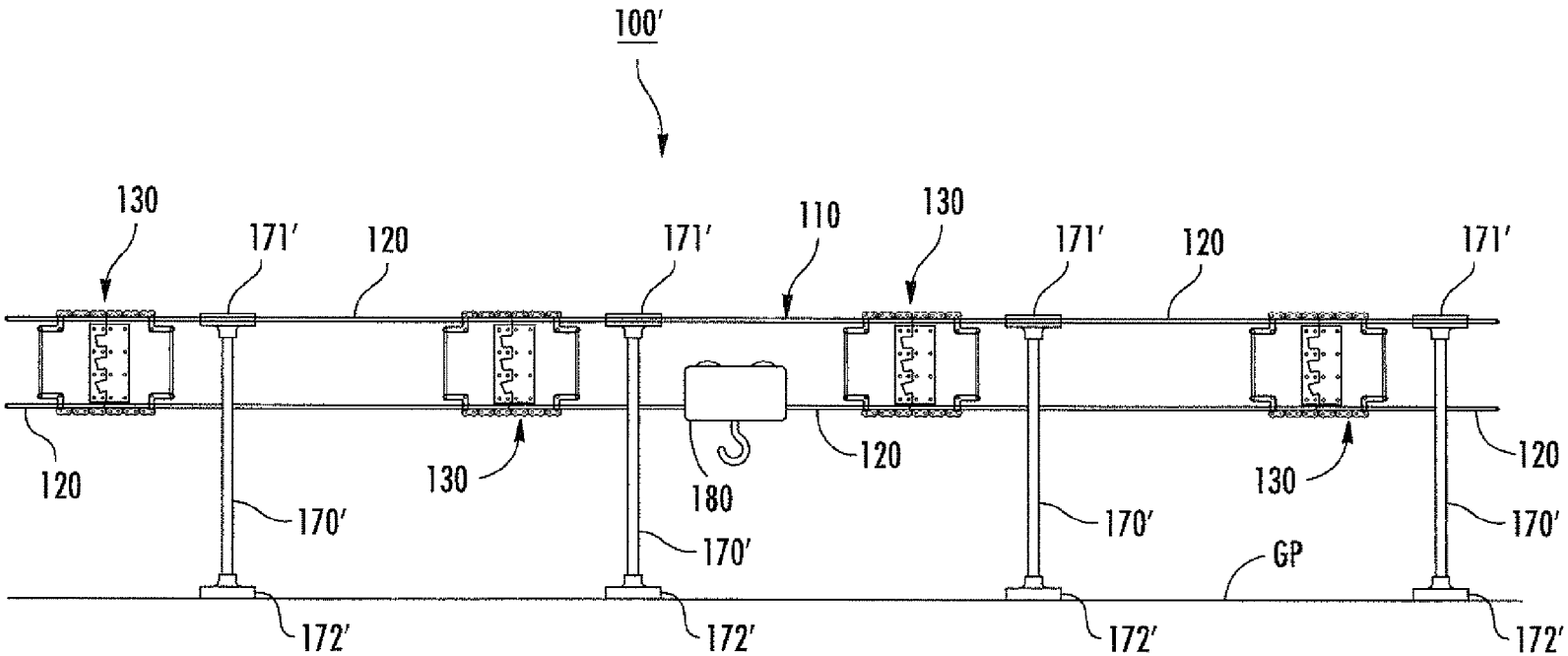
FIG. 2 is an elevational side view of an alternate embodiment of the rail transport system.

FIG. 2 shows a rail transport system 100' according to an alternate embodiment of the present disclosure, where like elements are identified by like reference characters. As shown in FIG. 2, the rail assembly 110 may be maintained above the ground plane by supporting it on the ground plane with length fixed and/or adjustable strut rods 170 whose lower ends are permanently or removably mounted on the ground plane.

The rail transport systems 100, 100' shown in FIGS. 1 and 2, each includes one or more rail-mounted devices 180, including but not limited to trolleys and carriers, that move along the rail transport system 100, 100' to quickly and efficiently move cabinets and equipment into and out of a combat space of a Naval ship without damaging the ship's false deck and associated grillwork, which are not capable of supporting the weight of the cabinets and other equipment being moved into the combat space. The rail transport system 100, 100' may also be used for the following purposes including, but not limited to transporting product through manufacturing processes, delivering articles within warehousing and distribution systems, delivering articles in mail and package sorting and delivery systems, to name a few.

Figure 4A:
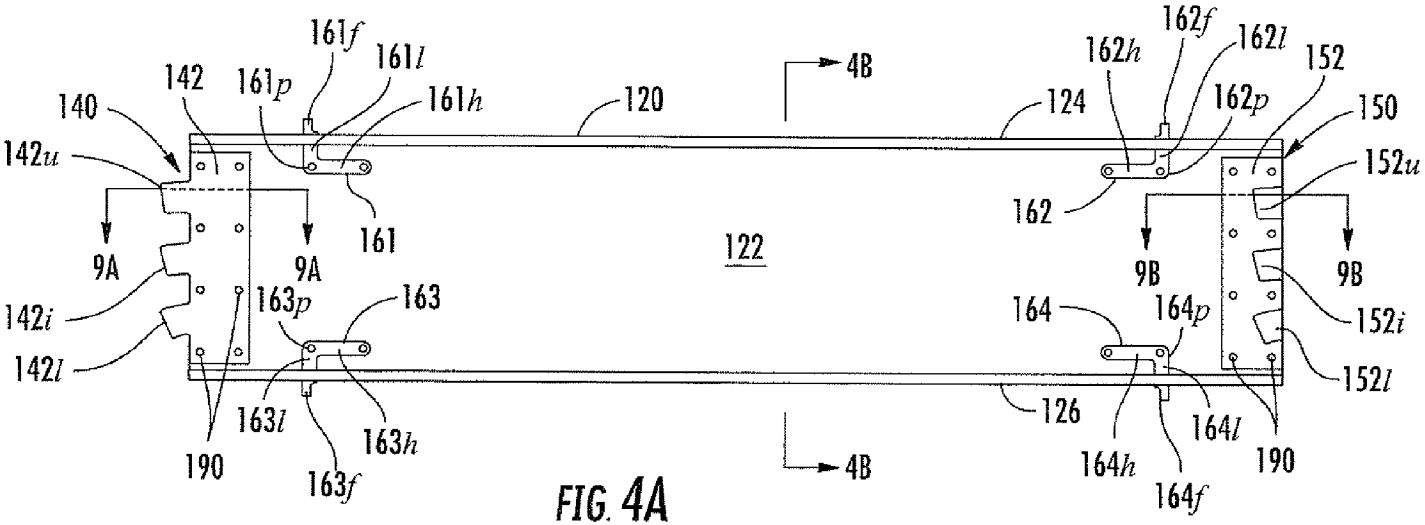
FIG. 4A is an elevational side view of a rail module according to an embodiment of the disclosure.
Figure 4B:
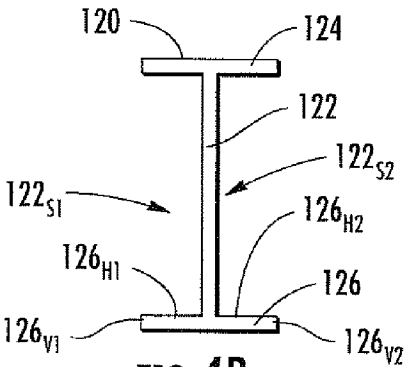
FIG. 4B is an elevational end view of the rail module.

The rail assembly 110 includes a plurality of rail modules 120 and a plurality of rail joining arrangements 130. The rail modules 120 of the rail assembly 110 may be straight, curved, and combinations thereof. Each rail joining arrangement 130 interconnects opposing ends of two of the rail modules 120. In one embodiment, as shown in FIGS. 4A and 4B, each of the rail modules 120 is unitary in construction and has an I-shape cross section formed by a vertical web member 122 extending along the longitudinal axis of the rail module, a horizontal upper flange member 124 extending along a top of the web member 122, and a horizontal lower flange member 126 extending along the bottom of the web member 122. The rail modules 120, are preferably formed from a high-strength, aluminum alloy material, including but not limited to 2014, 2024 and 7075, by extruding the aluminum alloy to a desired cross-section and length. The aluminum alloy construction provides for light-weight rail modules 120. The rail modules 120 may also be formed from other high-strength, light-weight alloys and other high-strength, light-weight materials.

The lower ends of the strut rods 170 are removably connected to the upper flange members of the rail modules 120, as shown for example in FIG. 5. Removable connection may be achieved in one embodiment by providing a slotted coupler 172 at the lower end of each strut rod 170 which is configured and adapted to slidably receive the upper flange and vertical web members 124, 122 of the rail modules 120.

As shown in FIG. 4B, the lower flange member 126 of each rail module defines a first horizontal riding surface $\mathbf{126}_{H1}$ and a first vertical riding surface $\mathbf{126}_{V1}$, on a first side $\mathbf{122}_{S1}$ of the vertical web member 122. The lower flange member 126 further defines a second horizontal riding surface $\mathbf{126}_{H2}$ and a second vertical riding surface $\mathbf{126}_{V2}$, on a second side $\mathbf{122}_{S2}$ of the vertical web member 122. In various applications of the rail assembly 110, the rail-engaging devices 180, (e.g., trolleys and carriers 118), may engage various combinations of the several riding surfaces as the application dictates. Although not shown, electrical conductors for communicating power, control, data signals, and the like, to the rail-engaging devices 180, may be secured to the vertical web members 122 of the rail modules 120.

Figure 7A:
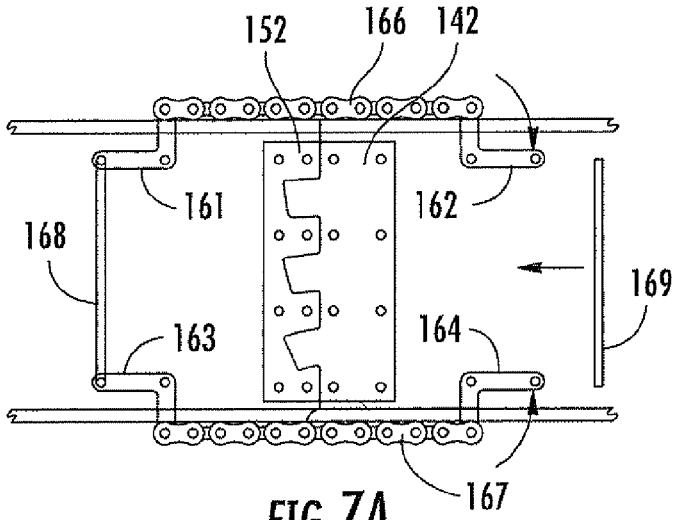
FIG. 7A is an enlarged detailed side view of a joining arrangement according to an embodiment of the disclosure.

Referring now to FIG. 7A, each of the joining arrangements 130 preferably includes a tongue plate assembly 140, a corresponding groove plate assembly 150, side plates 200, and a chain-wrench assembly 160, for quickly releasing and securing opposing rail modules 120. In some embodiments, as shown in FIG. 4A, the tongue plate assembly 140 is attached to a first end of each rail module of the rail assembly 110 and the corresponding groove plate assembly 150 is attached to a second end of each rail module of the rail assembly 110. In other embodiments, the tongue plate assemblies are attached to the first and second ends of alternating ones of the rail modules 120 of the rail assembly 110 and groove plate assemblies are attached to the first and second ends of the corresponding remaining rail modules 120 of the rail assembly 110.

Figure 8A:
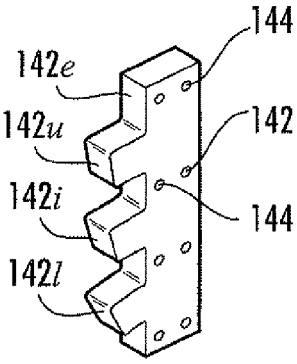
FIG. 8A is a perspective view of a tongue plate according to an embodiment of the disclosure.
Figure 8B:
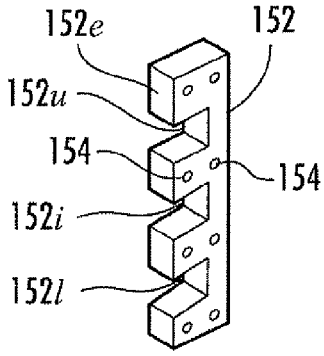
FIG. 8B is a perspective view a groove plate according to an embodiment of the disclosure.
Figure 9A:
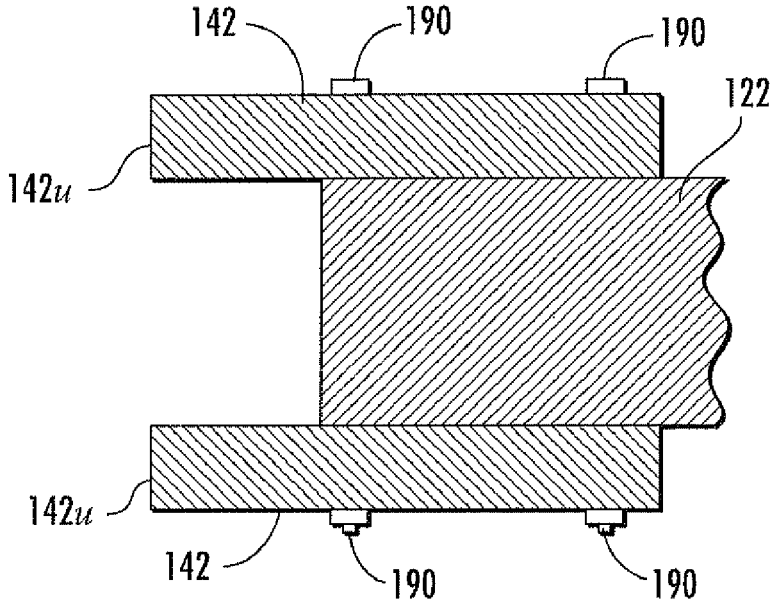
FIG. 9A is a sectional view through line 9A-9A of FIG. 4A.
Figure 9B:
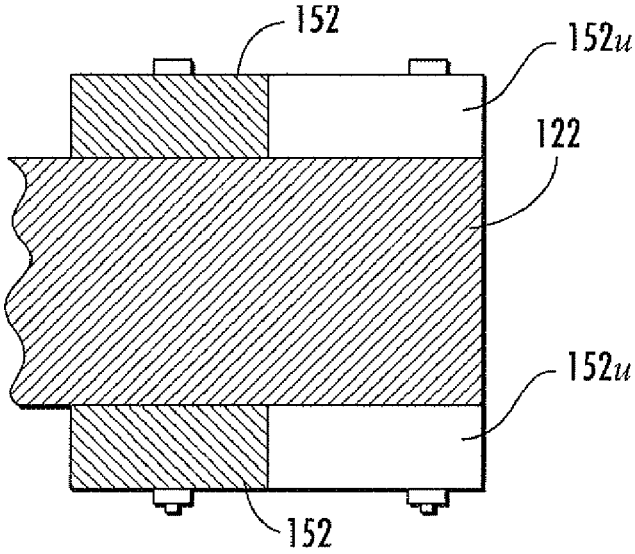
FIG. 9B is a sectional view through line 9B-9B of FIG. 4A.

In one embodiment, the tongue plate assembly 140 (FIGS. 8A and 9A) and the groove plate assembly 150 (FIGS. 8B and 9B) are each constructed as two, separate substantially identical planar members 142, 152. Each planar member includes a plurality of apertures 144, 154. The planar members are attached on opposing sides $\mathbf{122}_{S1}$ of the marginal end of the vertical web member 122 of the rail module 120. The apertures 144 and 154 of the planar members 142 and 152, respectively, align with each other and corresponding apertures (not visible) provided in the marginal end of the vertical web member 122 of the rail module 120 when the plates 142, 152 are positioned thereon. A plurality of nut and bolt type fasteners 190 extend through the tongue or groove plate planar member apertures 144 and 154 and corresponding web apertures provided the marginal end of the vertical web member 122 of the rail module 120, to attach the tongue and groove plate assembles 140 and 150 to the rail modules 120.

In the case of the tongue plate assembly 140, the front edge surface 142*e* of each planar member 142 includes three downwardly bent tongue elements 142*u*, 142*i*, 142*l*. The bend angles of the tongue elements 142*u*, 142*i*, 142*l* increase successively front the uppermost tongue element 142*u* to the lowermost tongue element 142*l*.

In the case of the groove plate assembly 150, the front edge surface 152*e* of each planar member 152 includes three downwardly bent groove elements 152*u*, 152*i*, 152*l* which are sized and shaped to correspond with and receive their respective downwardly bent tongue elements 142*u*, 142*i*, 142*l* of the tongue plate 142. As with the tongue elements 142*u*, 142*i*, 142*l*, the bend angles of the groove elements 152*u*, 152*i*, 152*l* increase successively from the uppermost groove element 152*u* to the lowermost groove element 152*l*.

Figure 7B:
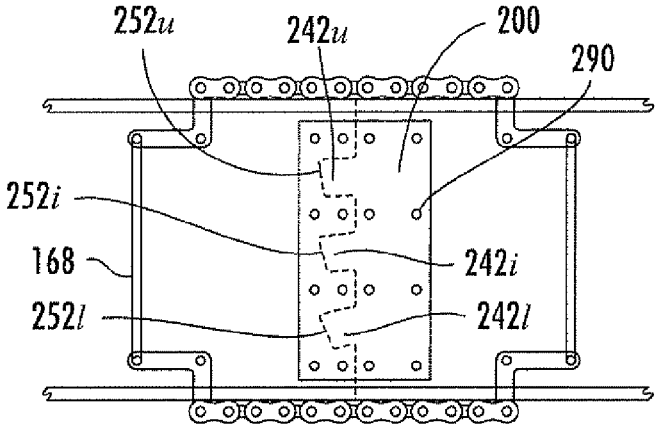
FIG. 7B is an enlarged detailed side view of a joining arrangement according to a second embodiment of the disclosure.

In an alternate embodiment of the joining arrangement, as shown in FIG. 7B, the tongue and groove plate assemblies 140 and 150 are omitted, and replaced by tongue elements 242*u*, 242*i*, 242*l* and groove elements 252*u*, 252*i*, 252*l* similar to those described earlier, machined into or unitarily formed at leading edge surfaces of vertical webs 122 of the rail modules 120. Planar side plates 200 are preferably bolted to the vertical web 122 of only one of the two rail modules 120 using fasteners 290, one side plate 200 on each side of the web 122, to align the modules 120 and retain the engagement of the tongue elements 242*u*, 242*i*, 242*l* with the groove elements 252*u*, 252*i*, 252*l* (shown with broken lines). In a less desirable embodiment, the side plates 200 may be bolted to the vertical webs 122 of both of the two rail modules, although this arrangement will slow down assembly and disassembly of the rail modules 120. The side plates may also be utilized with the tongue and groove plate assemblies 140 and 150 described earlier, to align the modules 120 and retain the engagement of the tongue and groove elements of the tongue and groove assemblies 140 and 150.

The tongue and groove assemblies 140 and 150, and the side plates 200 may be formed from a high-strength, aluminum alloy material, including but not limited to 6061-T6, 2014, 2024 and 7075, other high-strength, light-weight alloys and other high-strength, light-weight materials.

Referring again to FIG. 7A, the chain-wrench assembly 160 in one embodiment, includes first and second L-shape upper lever-wrenches 161 and 162, first and second L-shape lower lever-wrenches 163, 164, an upper chain 166 removably connecting the first and second upper wrenches 161 and 162 and a lower chain 167 removably connecting the first and second lower wrenches 163 and 164, Each L-shape lever-wrench 161, 162, 163, 164 includes a handle member 161*h*, 162*h*, 163*h*, 164*h*, a lever member 161*l*, 162*l*, 163*l*, 164*l* with a chain link catch finger 161*f*, 162*f*, 163*f*, 164*f* disposed at a free end thereof, and a pivot member 161*p*, 162*p*, 163*p*, 164*p* disposed at the junction of the handle and lever members. The pivot member 161*p* of the first upper lever-wrench 161 pivotally attaches the first upper lever-wrench 161 to the vertical web member 122 of a first rail module 120 at a location which is adjacent to the horizontal upper flange member 124 and a first end of the first rail module 120 such that the lever member 161*l* of the first upper lever-wrench 161 extends through a longitudinally elongated slot (not shown) in the horizontal upper flange member 124 of the first rail module 120. The pivot member 163*p* of the first lower lever-wrench 163 pivotally attaches the first lower lever-wrench 163 to the vertical web member 122 of the first rail module 120 at a location which is adjacent to the horizontal lower flange member 126 and the first end of the first rail module 120 such that the lever member 163*p* of the first lower lever-wrench 163 extends through a longitudinally elongated slot (not shown) in the horizontal lower flange member 126 of the first rail module 120. The pivot member 162*p* of the second upper lever-wrench 162 pivotally attaches the second upper lever-wrench 162 to the vertical web member 122 of a second opposing rail module 120 at a location which is adjacent to the horizontal upper flange member 124 and a first end of the second rail module 120 such that the lever member 162*l* of the second upper lever-wrench 162 extends through a longitudinally elongated slot (not shown) in the horizontal upper flange member 124 of the second rail module 120. The pivot member 164*p* of the second lower lever-wrench 164 pivotally attaches the second lower lever-wrench 164 to the vertical web member 122 of the second rail module 120 at a location which is adjacent to the horizontal lower flange member 126 and the first end of the second rail module 120 such that the lever member 164*l* of the second lower lever-wrench 164 extends through a longitudinally elongated slot (not shown) in the horizontal lower flange member 126 of the second rail module 120.

Figure 6:
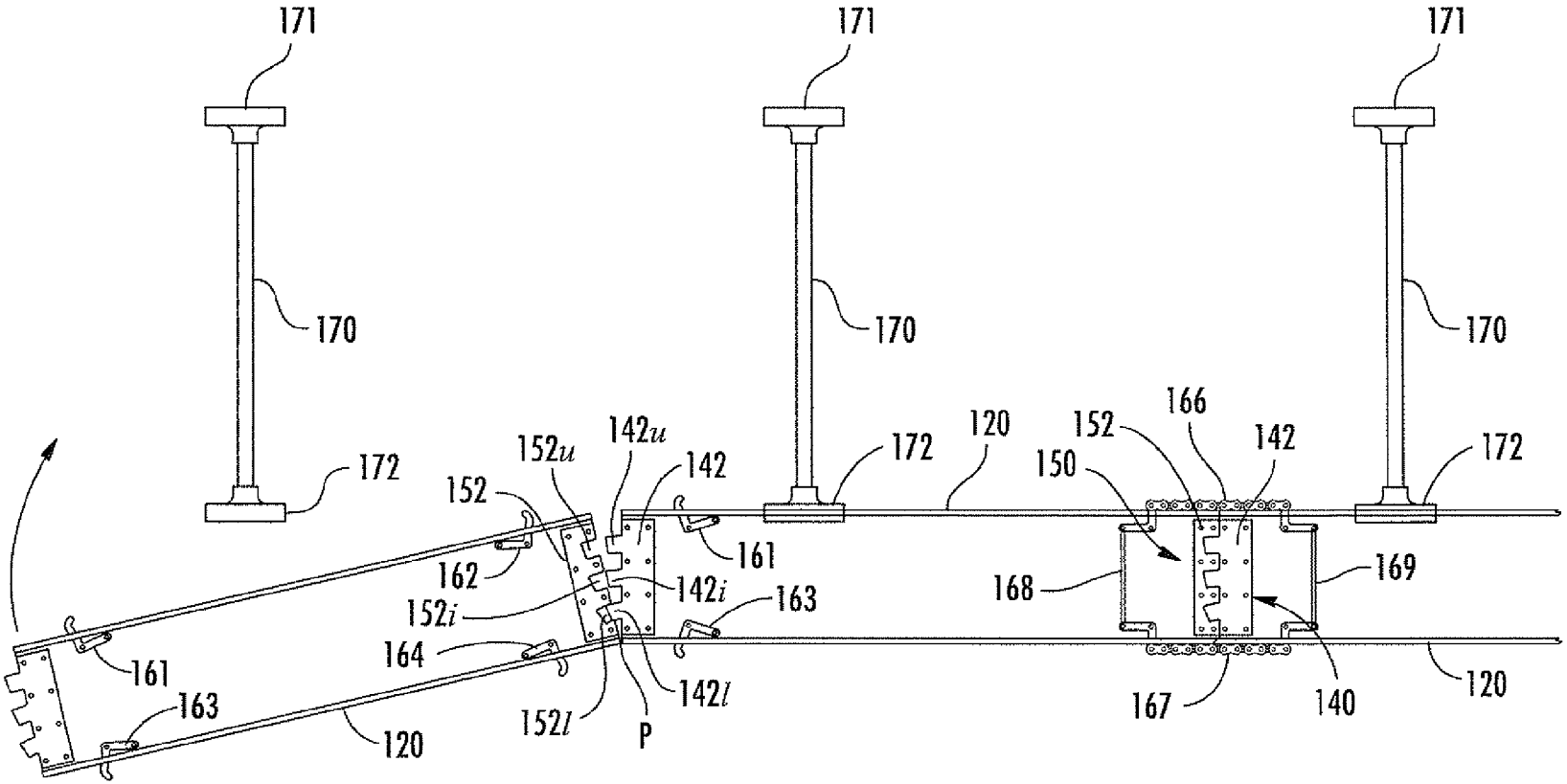
FIG. 6 is an elevational side view illustrating a method for assembling the rail modules to one another.

The downwardly bent tongue and groove elements 142*u*, 142*i*, 142*l*, 152*u*, 152*i*, 152*l* allow for quick and easy assembly of the rail assembly 110 from the ground plane GP, as shown in FIG. 6. Because the lowermost tongue and groove elements 142*l* and 152*l* are bent downwardly at the greatest angle, it allows for easy initial engagement of the second rail module 120 to a corresponding suspended or supported first rail module 120. Once the lowermost tongue and groove elements 142*i* and 152*i* are partially engaged, the second rail module 120 may be pivoted up about pivot point P and moved toward the suspended or supported first rail module 120 using the lowermost tongue and groove elements 142*l* and 152*l* as a sliding pivot point, to partially engage the intermediate tongue and groove elements 142*i* and 152*i* and then partially engage the uppermost tongue and groove elements 142*u* and 152*u*. As the uppermost tongue and groove elements 142*u* and 152*u* are brought together into full engagement, the lowermost tongue and groove elements 142*l* and 152*l* become fully engaged followed by full engagement of the intermediate tongue and groove elements 142*i* and 152*i* and finally full engagement of the upper tongue and groove elements 142*u* and 152*u*. The downwardly bent angles of the tongue and groove elements 142*u*, 142*i*, 142*l*, 152*u*, 152*i*, 152*l* also resist sagging at the rail module joints better than straight angle tongue and groove elements.

After the first and second rail modules 120 are together, the upper and lower chains 166, 167 are connected to their corresponding lever-wrenches 161, 162, 163, 164 and tensioned to compress and thereby hold the first and second rail modules 120 together. More specifically, a first end link of the upper chain 166 may be connected to the chain link catch finger 161*f* of the first upper lever-wrench 161 and a second end link of the upper chain 166 may be connected to the chain link catch finger 162*f* of the second upper lever-wrench 162. A first end link of the lower chain 167 may be connected to the chain link catch finger 163*f* of the first lower lever-wrench 163 and a second end link of the lower chain 167 may be connected to the chain link catch finger 164*f* of the second lower lever-wrench 164. The upper chain 166 may be tensioned by manually grasping the handle members 161*h*, 162*h* of the first and second upper lever-wrenches 161, 162 and rotating them down about their pivot members 161*p*, 162*p*. Similarly, the lower chain 167 may be tensioned by manually grasping the handle members 163*h*, 164*h* of the first and second lower lever-wrenches 163, 164 and rotating them up about their pivot members 163*p*, 164*p*. A first lock rod 168 may be removably connected to free ends of the handle members 161*h*, 163*h* of the first upper and lower lever-wrenches 161, 163 and a second lock rod 169 may be removably connected to free ends of the handle members 162*h*, 164*h* of the second upper and lower lever-wrenches 162, 164 to prevent them from rotating and releasing the tension on the upper and lower chains 166, 167.

Figure 3:
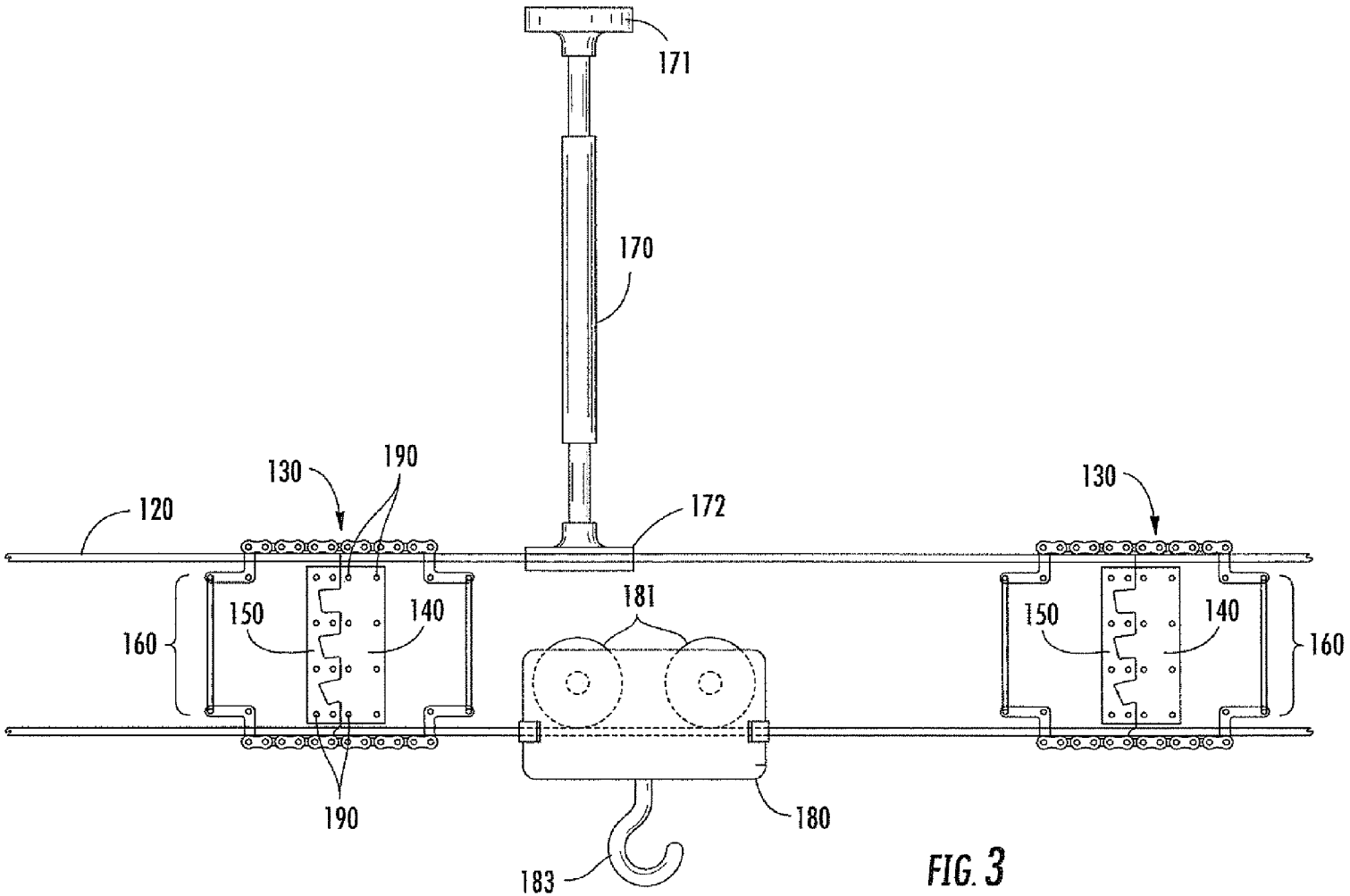
FIG. 3 is an enlarged elevational side view of the rail transport system of FIG. 1.

The rail-mounted transport device 180 shown in FIGS. 3 and 5 comprises a trolley. The trolley 180 may include first and second pairs of track rollers 181, 182 which carry the trolley 180 on the lower flange horizontal riding surfaces $\mathbf{126}_{H1}$, $\mathbf{126}_{H2}$ of the rail modules 120. A hook 183 may be connected to a bottom of the trolley 180 for connecting articles, e.g., cabinets and equipment, that are to be transported by the trolley on the rail transport system 100, 100'.

The rail transport system 100, 100' provides a fast and efficient system for transporting articles. Since each rail module 120 is very light via its aluminum or plastic construction, the entire system may be installed and assembled as described above, by a single person.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A rail transport system comprising:

a rail assembly including at least two rail modules;

at least one angled tongue element disposed at an end of the at least two rail modules, wherein the angled tongue element is bent; and at least one angled groove element disposed at an end of the other one of the at least two rail modules, the at least one angled groove element bent at a complementary angle for receiving the at least one angled tongue element when the at least two rail modules are assembled together.

2. The rail transport system of claim 1, further comprising at least one transport device for running along the rail assembly and transporting articles from one location to another.

3. The rail transport system of claim 2, wherein the at least one transport device comprises a trolley.

4. The rail transport system of claim 1, further comprising a first chain for securing the at least two rail modules to one another.

5. The rail transport system of claim 4, further comprising a first lever wrench disposed on one of the at least two rail modules and a second lever wrench disposed on the other one of the at least two rail modules, the first and second lever wrenches for tensioning the first chain.

6. The rail transport system of claim 5, further comprising a second chain for securing the at least two rail modules to one another.

7. The rail transport system of claim 6, further comprising a third lever wrench disposed on one of the at least two rail modules and a fourth lever wrench disposed on the other one of the at least two rail modules, the third and fourth lever wrenches for tensioning the second chain.

8. The rail transport system of claim 4, further comprising a second chain for securing the at least two rail modules to one another.

9. The rail transport system of claim 1, further comprising at least two strut rods for suspending the rail assembly over a ground plane.

10. The rail transport system of claim 9, wherein the ground plane is a false deck of a ship.

11. The rail transport system of claim 9, wherein the strut rods are adjustable in length.

12. The rail transport system of claim 1, wherein the at least one angled tongue element is downwardly bent and wherein the at least one angled groove element is downwardly bent.

13. The rail transport system of claim 1, wherein the at least one angled tongue element comprises three downwardly bent tongue elements and wherein the at least one angled groove element comprises three downwardly bent tongue elements.

14. The rail transport system of claim 13, wherein bend angles of the tongue elements increase successively from an uppermost tongue element to a lowermost tongue element and wherein bend angles of the groove elements increase successively from an uppermost groove element to a lowermost groove element.

15. A method for moving articles into and out of a combat space on a ship, the method comprising the steps of:

suspending a rail transport system above a false deck of the ship, the rail transport system including rail assembly and a transport device movable along the rail assembly, the rail assembly including at least two rail modules, at least one angled tongue element that is bent and disposed at an end of the at least two rail modules, and at least one angled groove element disposed at an end of the other one of the at least two rail modules, the at least one angled groove element bent at a complementary angle for receiving the at least one angled tongue element when the at least two rail modules are assembled together;

at a location remote from the combat space, attaching one of the articles to the transport device;

moving the transport device along the rail assembly to the combat space; and detaching the article from the transport device at the combat space.

16. The method of claim 15, wherein the at least one transport device comprises a trolley.

17. The method of claim 15, wherein the suspending step includes the step of securing the at least two rail modules to one another with a first chain.

18. The method of claim 17, wherein the suspending step further includes the step of tensioning the first chain with a first lever wrench disposed on one of the at least two rail modules and a second lever wrench disposed on the other one of the at least two rail modules.

19. The method of claim 18, wherein the suspending step further includes the step of further securing the at least two rail modules to one another with a second chain.

20. The method of claim 19, wherein the suspending step further includes the step of tensioning the second chain with a third lever wrench disposed on one of the at least two rail modules and a fourth lever wrench disposed on the other one of the at least two rail modules.

21. The method of claim 17, wherein the suspending step further includes the step of further securing the at least two rail modules to one another with a second chain.

22. The method of claim 15, wherein the suspending step farther includes the steps of:

attaching at least two strut rods to an overhead structure of the ship; and attaching the rail assembly to the at least two strut rods.

23. The method of claim 22, further comprising the step of adjusting the length of at least one of the strut rods to suspend the rail transport system above the false deck of the ship in a level manner.

24. The method of claim 15, wherein the at least one angled tongue element is downwardly bent and wherein the at least one angled groove element is downwardly bent.

25. The method of claim 15, wherein the at least one angled tongue element comprises three downwardly bent tongue elements and wherein the at least one angled groove element comprises three downwardly bent tongue elements.

26. The method of claim 25, wherein bend angles of the tongue elements increase successively from an uppermost tongue element to a lowermost tongue element and wherein bend angles of the groove elements increase successively from an uppermost groove element to a lowermost groove element.

27. A rail transport system comprising:

a rail assembly including at least two rail modules;

at least one angled tongue element disposed at an end of the at least two rail modules; and at least one angled groove element disposed at an end of the other one of the at least two rail modules, the at least one angled groove element for receiving the at least one angled tongue element when the at least two rail modules are assembled together, wherein the at least one angled tongue element is downwardly bent and wherein the at least one angled groove element is downwardly bent.

28. A rail transport system comprising:

a rail assembly including at least two rail modules;

at least one angled tongue element disposed at an end of the at least two rail modules;

a first tensioning member for securing the at least two rail modules to one another;

a first lever wrench disposed on one of the at least two rail modules and a second lever wrench disposed on the other one of the at least two rail modules, the first and second lever wrenches for tensioning the first tensioning member; and at least one angled groove element disposed at an end of the other one of the at least two rail modules, the at least one angled groove element for receiving the at least one angled tongue element when the at least two rail modules are assembled together.

29. A method for moving articles into and out of a combat space on a ship, the method comprising the steps of:

suspending a rail transport system above a false deck of the ship, the rail transport system including rail assembly and a transport device movable along the rail assembly, the rail assembly including at least two rail modules, at least one angled tongue element disposed at an end of the at least two rail modules, and at least one angled groove element disposed at an end of the other one of the at least two rail modules, the at least one angled groove element for receiving the at least one angled tongue element when the at least two rail modules are assembled together;

at a location remote from the combat space, attaching one of the articles to the transport device;

moving the transport device along the rail assembly to the combat space; and detaching the article from the transport device at the combat space, wherein the at least one angled tongue element is downwardly bent and wherein the at least one angled groove element is downwardly bent.

30. A method for moving articles into and out of a combat space on a ship, the method comprising the steps of:

suspending a rail transport system above a false deck of the ship, the rail transport system including rail assembly and a transport device movable along the rail assembly, the rail assembly including at least two rail modules, at least one angled tongue element disposed at an end of the at least two rail modules, and at least one angled groove element disposed at an end of the other one of the at least two rail modules, the at least one angled groove element for receiving the at least one angled tongue element when the at least two rail modules are assembled together;

at a location remote from the combat space, attaching one of the articles to the transport device;

moving the transport device along the rail assembly to the combat space; and detaching the article from the transport device at the combat space, wherein the suspending step includes the step of securing the at least two rail modules to one another with a first tensioning member by tensioning the first tensioning member with a first lever wrench disposed on one of the at least two rail modules and a second lever wrench disposed on the other one of the at least two rail modules.

* * * * *